US010071320B2

(12) United States Patent
Levine

(10) Patent No.: US 10,071,320 B2
(45) Date of Patent: Sep. 11, 2018

(54) MULTI-CONFIGURABLE TOY VEHICLE

(71) Applicant: Mattel, Inc., El Segundo, CA (US)

(72) Inventor: Esther Levine, Studio City, CA (US)

(73) Assignee: Mattel, Inc., El Segundo, CA (US)

( * ) Notice: Subject to any disclaimer, the term of this patent is extended or adjusted under 35 U.S.C. 154(b) by 594 days.

(21) Appl. No.: 14/046,877

(22) Filed: Oct. 4, 2013

(65) Prior Publication Data

US 2014/0099862 A1 Apr. 10, 2014

Related U.S. Application Data

(60) Provisional application No. 61/710,479, filed on Oct. 5, 2012.

(51) Int. Cl.

| | |
|---|---|
| ***A63H 17/36*** | (2006.01) |
| ***A63H 17/26*** | (2006.01) |
| ***A63H 33/00*** | (2006.01) |
| ***A63H 17/00*** | (2006.01) |

(52) U.S. Cl.

CPC ..... *A63H 17/262* (2013.01); *A63H 17/002* (2013.01); *A63H 33/003* (2013.01)

(58) Field of Classification Search

CPC ..... A63H 17/36

USPC ..... 446/470

See application file for complete search history.

(56) References Cited

U.S. PATENT DOCUMENTS

| | | | | |
|---|---|---|---|---|
| 2,208,176 A | | 7/1940 | Arnold | |
| 2,791,867 A | | 5/1957 | Dasher | |
| 2,852,373 A | * | 9/1958 | Kleinert | G03C 5/22 430/320 |
| 3,032,217 A | * | 5/1962 | Musson | B60P 3/07 254/3 R |

(Continued)

FOREIGN PATENT DOCUMENTS

| | | |
|---|---|---|
| GB | 2068751 | 8/1981 |
| GB | 2156698 | 10/1985 |

(Continued)

OTHER PUBLICATIONS

State Intellectual Property Office of the People'S Republic of China, Office Action for Chinese Patent Application No. 201310462977.0, dated Jun. 26, 2015, 4 pages. Applicant believes this Office Action indicates that the expression "the enclosure comprises one a plurality of movable walls" in Claim 20 is unclear. Claim 20 is rejected based on an assertion that it does not comply with the provision of Art. 26.4 of the Chinese Patent Law.

(Continued)

*Primary Examiner* — John E Simms, Jr.
*Assistant Examiner* — Dolores Collins
(74) *Attorney, Agent, or Firm* — Kolisch Hartwell, P.C.

(57) ABSTRACT

A multi-configurable toy vehicle is described. The multi-configurable toy vehicle comprises a cab and a vehicle body. The cab comprises a first set of one or more wheels and the vehicle body comprises a second set of one or more wheels. The vehicle body is slidably coupled to the cab between a collapsed and expanded configuration. The vehicle body comprises a floor and a platform pivotally coupled to the floor between an upright position and an open position. A trailer may be coupled to the multi-configurable toy vehicle.

20 Claims, 13 Drawing Sheets

(56) References Cited

U.S. PATENT DOCUMENTS 3,124,386 A * 3/1964 Jonas ..... B60P 3/34 296/176
3,701,217 A * 10/1972 Jensen ..... A63H 17/002 446/470
3,711,990 A * 1/1973 Pfeilsticker ..... 446/428
4,192,093 A * 3/1980 Hamano ..... 446/427
4,213,268 A * 7/1980 Erickson et al. ..... 446/180
4,236,345 A 12/1980 Inoue
4,244,144 A * 1/1981 Goldberg ..... A63F 9/12 446/279
4,249,339 A 2/1981 Crain et al.
4,382,347 A 5/1983 Murakami
4,391,060 A * 7/1983 Nakane ..... 446/94
4,397,497 A * 8/1983 Alonzo, Jr. ..... B60P 3/32 296/100.03
4,467,556 A * 8/1984 Iwao ..... A63H 33/003 446/230
4,477,999 A * 10/1984 Harigai ..... A63H 33/003 446/470
4,504,239 A 3/1985 Kulesza et al.
4,516,948 A * 5/1985 Obara ..... A63H 33/003 446/376
4,530,670 A * 7/1985 Ohno ..... A63H 33/003 446/435
4,599,078 A * 7/1986 Obara ..... 446/95
4,685,894 A 8/1987 Beny et al.
4,737,135 A 4/1988 Johnson et al.
4,778,196 A * 10/1988 Spoliansky ..... 280/512
4,804,349 A * 2/1989 Loscalzo et al. ..... 446/93
4,850,929 A * 7/1989 Genevey ..... 446/466
4,869,700 A * 9/1989 Reiling, Jr. ..... A63H 17/264 446/434
4,889,516 A * 12/1989 Auer et al. ..... 446/462
4,891,995 A 1/1990 Lin
5,282,661 A * 2/1994 Arnberger ..... B60P 3/34 180/89.12
5,328,402 A * 7/1994 Hallford ..... 446/427
5,432,963 A * 7/1995 Coral ..... A47C 17/38 5/118
5,816,888 A 10/1998 Myers
6,106,356 A * 8/2000 Trageser ..... 446/72
6,106,361 A * 8/2000 Petris ..... A63H 17/00 446/431
6,517,135 B2 * 2/2003 de Gaillard ..... B60J 7/026 296/26.08
6,749,482 B1 * 6/2004 Hollis et al. ..... 446/466
7,810,866 B2 * 10/2010 Dempsey ..... B60P 3/341 296/169
7,942,721 B2 * 5/2011 Wade ..... A63H 17/02 446/429
7,950,977 B2 5/2011 Sun et al.
8,033,776 B2 * 10/2011 Calhoun ..... B65G 67/24 294/26
8,079,633 B2 * 12/2011 Cunningham ..... B60P 3/07 296/158
8,298,038 B2 * 10/2012 O'Connor ..... A63H 18/04 446/429
8,419,498 B2 * 4/2013 Furusawa et al. ..... 446/71
2007/0173174 A1 7/2007 Sun et al.
2012/0045965 A1 * 2/2012 Zhou ..... A63H 3/52 446/478
2012/0309263 A1 * 12/2012 Lennon ..... A63H 18/025 446/444

FOREIGN PATENT DOCUMENTS

JP 0241193 2/1990
JP 201162400 3/2011

OTHER PUBLICATIONS

State Intellectual Property Office of P.R. China, Office Action for Chinese Application No. 201310462977.0, dated Mar. 9, 2016, 5 pages.
State Intellectual Property Office of The People's Republic of China, "Notification of Reexamination" in connection with related Chinese Patent Application No. 201310462977.0, dated Jun. 28, 2018, 15 pages.

* cited by examiner

MULTI-CONFIGURABLE TOY VEHICLE

CROSS-REFERENCE TO RELATED APPLICATIONS

The present Application for Patent claims priority to Provisional Application No. 61/710,479, filed Oct. 5, 2012, entitled "MULTI-CONFIGURABLE TOY VEHICLE", which is assigned to the assignee hereof, and is expressly incorporated in its entirety by reference herein.

BACKGROUND

The success of a toy is measured by how effectively it is able to capture and engage a child's imagination. Toy dolls and play sets, for example, provide a means by which children are able to recreate and adapt real life scenarios in a play setting. Play sets and toys that are able to transform from one configuration to another further engage the child by offering an element of surprise. Such toys have become toy box staples for many children.

Furthermore, as a child's appetite for several different types of toys often exceeds available space or a parent's budget or tolerance for them, toys which are configurable to different forms or uses are desirable. What is therefore needed is a toy that is capable of being configured or adapted to one of a variety of different forms or uses.

SUMMARY

A multi-configurable toy vehicle is described. The multi-configurable toy vehicle comprises a cab and a vehicle body. The cab comprises a first set of one or more wheels and the vehicle body comprises a second set of one or more wheels. The vehicle body is slidably coupled to the cab between a collapsed and an expanded configuration.

In accordance with a first aspect, the cab comprises an internal cavity configured to house a figurine.

In accordance with a second aspect, the first pair of side walls is substantially disposed within the cab in the collapsed configuration.

In accordance with a third aspect, the second set of wheels is substantially disposed within the cab in the collapsed configuration.

In accordance with a fourth aspect, the vehicle body comprises a first pair of side walls that includes a feature that limits movement of the body relative to the cab in a collapsed configuration.

In accordance with a fifth aspect, the first pair of side walls each comprises a first end proximal to the cab and a second end distal to the cab. The first end further comprises a latch that engages the cab to prevent the vehicle body from becoming slidably disengaged from the cab in the expanded configuration.

In accordance with a sixth aspect, the latch projects inwardly between the first pair of side walls.

In accordance with a seventh aspect, the vehicle body comprises floor and a platform pivotally coupled to the floor between an upright position and an open position.

In accordance with an eighth aspect, the platform further comprises a second pair of side walls.

In accordance with a ninth aspect, in the upright position, an enclosure is defined by the floor, the second pair of side walls and the platform.

In accordance with a tenth aspect, in the upright position the second pair of side walls is substantially disposed within the first pair of side walls.

In accordance with an eleventh aspect, the multi-configurable toy vehicle further comprises a trailer.

In accordance with a twelfth aspect, the trailer comprises two portions hingedly attached to one another, the two portions being configured to open to define a play area and to close for attachment to the cab.

In accordance with a thirteenth aspect, the cab is in the collapsed state and the trailer is coupled to the cab.

Other objects, features and advantages of the described preferred embodiments will become apparent to those skilled in the art from the following detailed description. It is to be understood, however, that the detailed description and specific examples, while indicating preferred embodiments of the multi-configurable toy vehicle, are given by way of illustration and not limitation. Many changes and modifications within the scope of the multi-configurable toy vehicle as disclosed herein may be made without departing from the spirit thereof, and the multi-configurable toy vehicles as disclosed herein are understood to include all such modifications.

BRIEF DESCRIPTION OF THE DRAWINGS

Like numerals refer to like parts throughout the several views of the drawings.

DETAILED DESCRIPTION

Specific, non-limiting embodiments of the multi-configurable toy vehicles will now be described with reference to the drawings. It should be understood that such embodiments are by way of example only and merely illustrative of but a small number of embodiments within the scope of multi-configurable toy vehicles. Various changes and modifications obvious to one skilled in the art to which such multi-configurable toy vehicles pertain are deemed to be within the spirit, scope and contemplation of the multi-configurable toy vehicles as further defined in the appended claims.

Figure 1A:
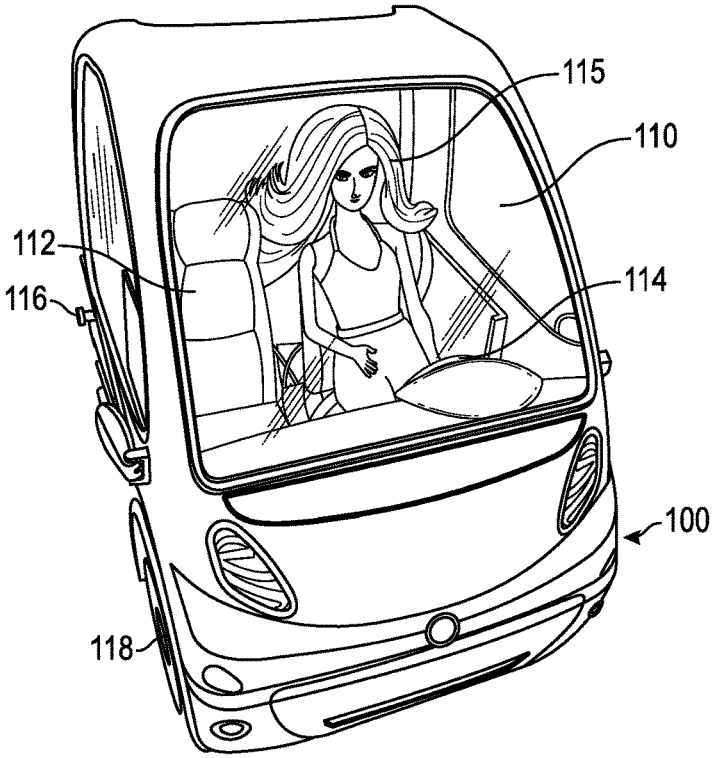
FIGS. 1A, 1B and 1C are front, side and rear perspective views, respectively, of an embodiment of the multi-configurable toy vehicle in which the vehicle body is substantially collapsed within the cab.
Figure 1B:
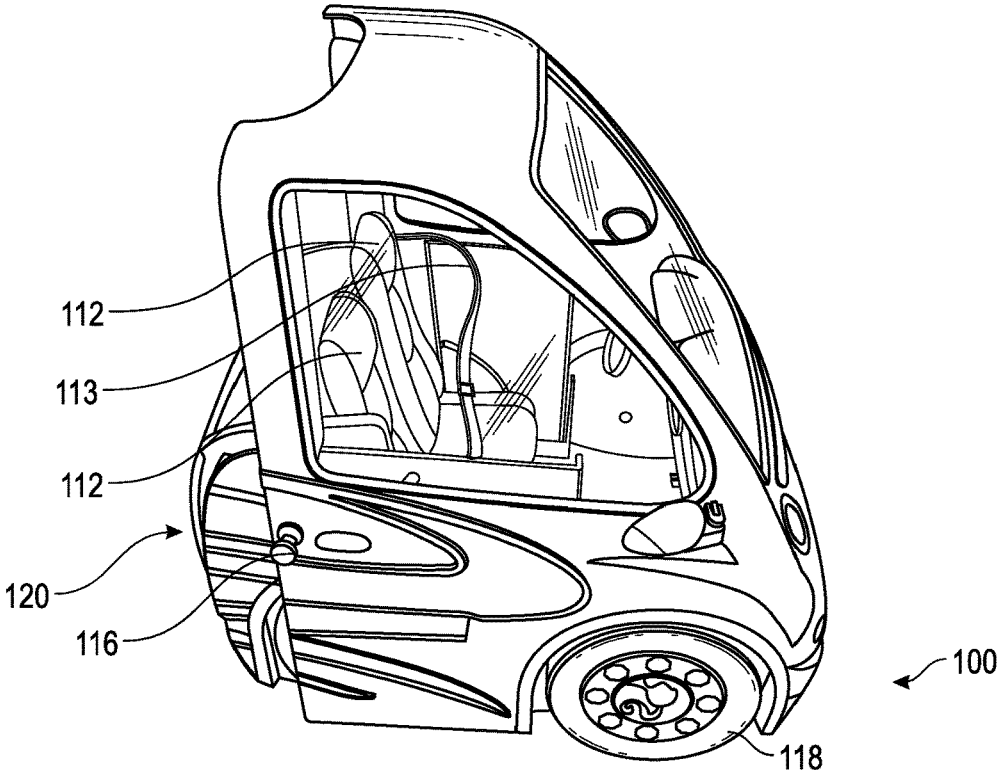
Figure 1C:
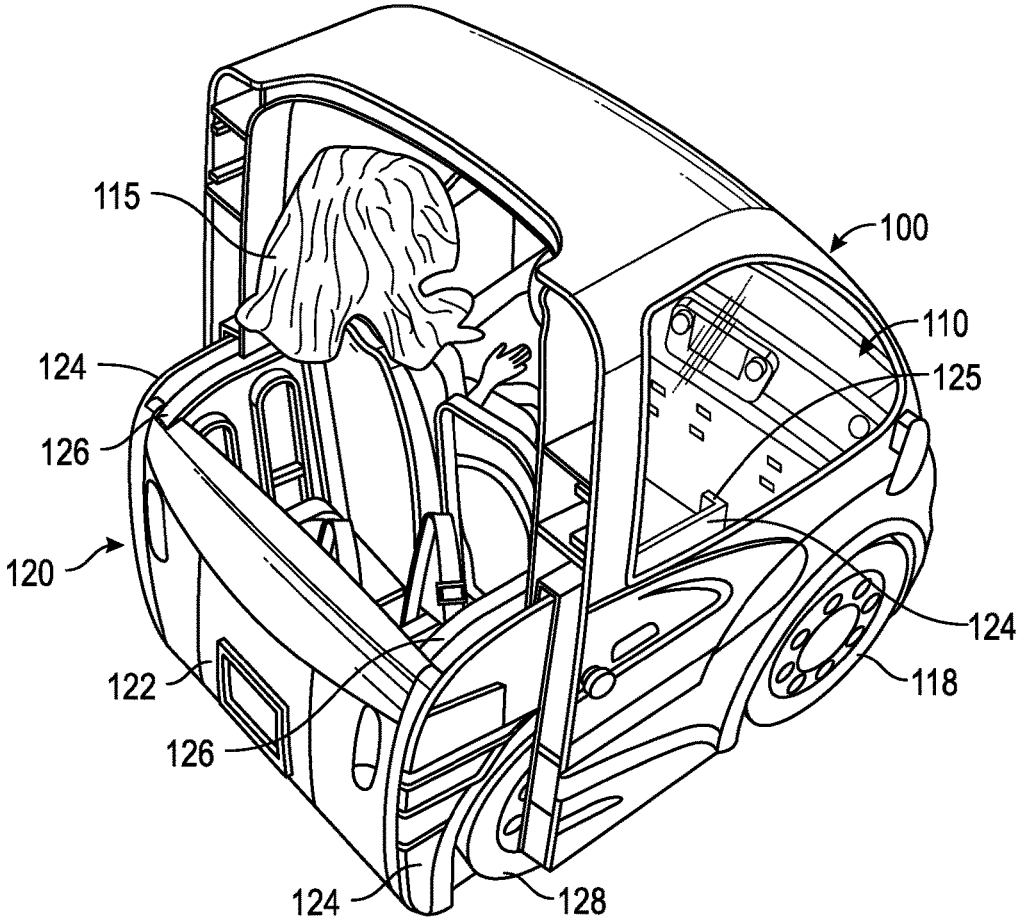

FIGS. 1A, 1B and 1C depict the multi-configurable toy vehicle in the collapsed configuration. In this configuration, the cab 100 is provided as comprising a pair of wheels 118 and an interior 110. The interior 110 preferably comprises at least one seat 112, a steering wheel 114 and seat belts 113. The cab 100 is further provided with a protrusion 116 which serves as an attachment point for additional accessories, such as a trailer 130 as shown in FIGS. 7A-E. As shown in FIG. 1A, the interior 110 is adapted such that up to two figurines may be placed within the cab 100. A doll 115 is shown positioned in a seated configuration within the cab 100. The vehicle body 120 is depicted as being collapsed and, preferably, at least substantially collapsed within the cab 100.

In one embodiment, the side walls 124 are substantially disposed within the cab 100 in the collapsed configuration. At least half of the length of the cab side walls 124, preferably, at least three-quarters of the length of the cab side walls 124 (as shown in FIG. 1C), and most preferably, the entire length of the cab side walls 124 are disposed within the cab in the collapsed configuration. Additionally, a pair of rear wheels 128 may be substantially disposed within the cab 100 in the collapsed configuration, and thus substantially hidden from view.

Figure 2A:
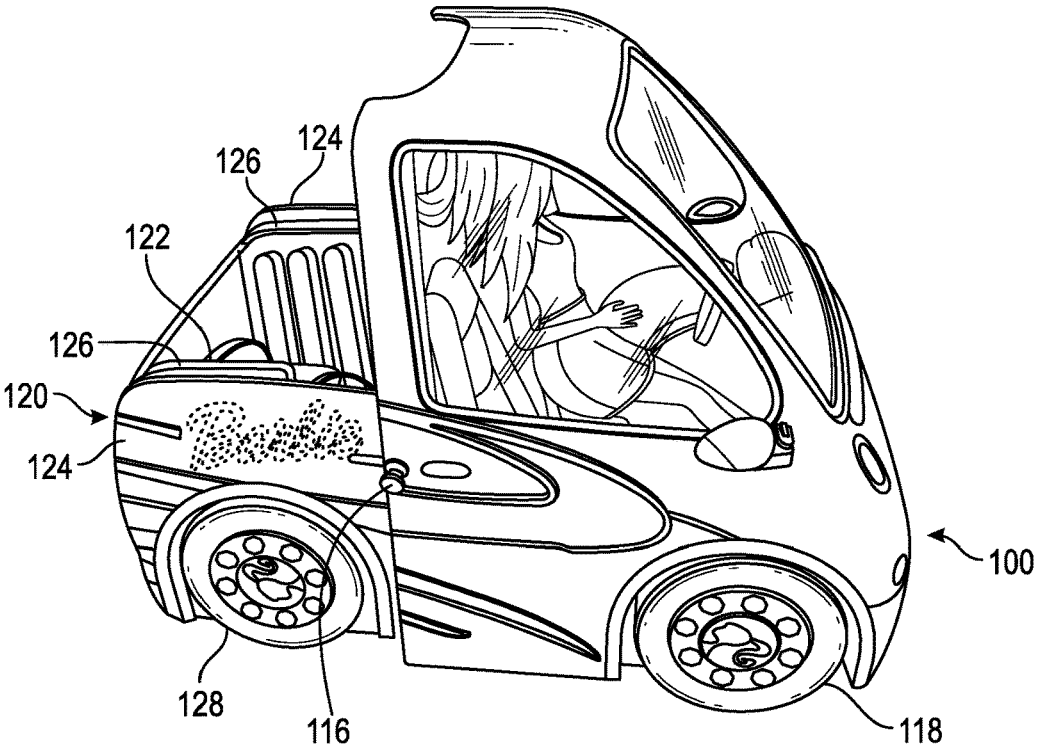
FIGS. 2A and 2B are side and rear respective views, respectively, of an embodiment of the multi-configurable toy vehicle in which the vehicle body is expanded from the cab.
Figure 2B:
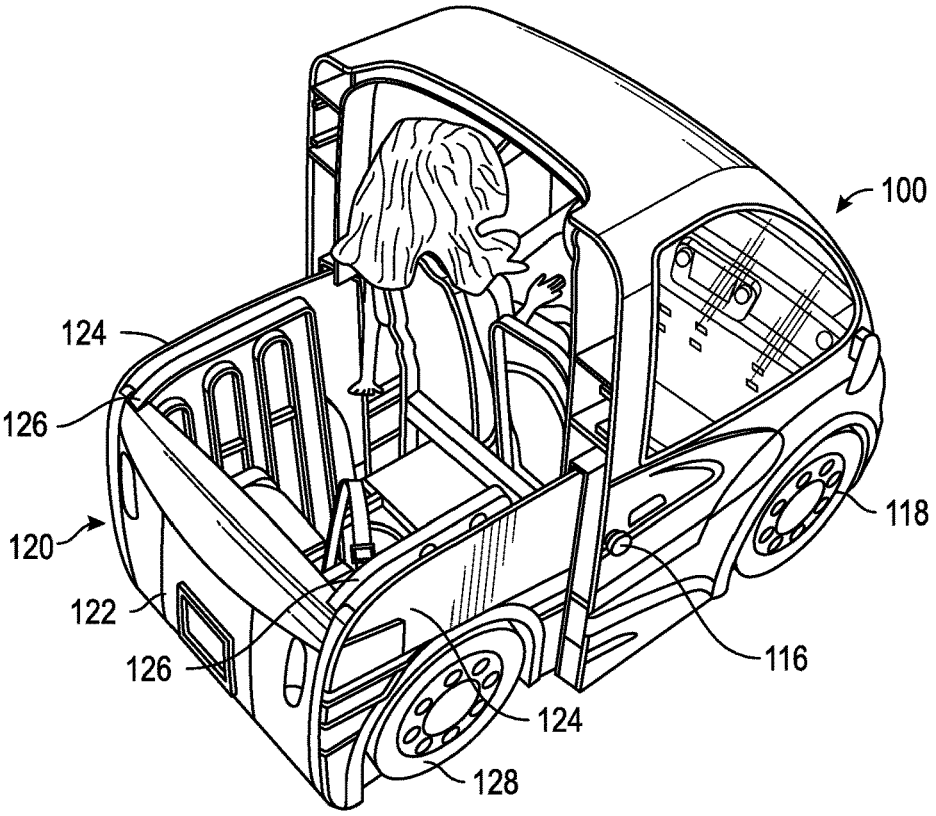
Figure 6A:
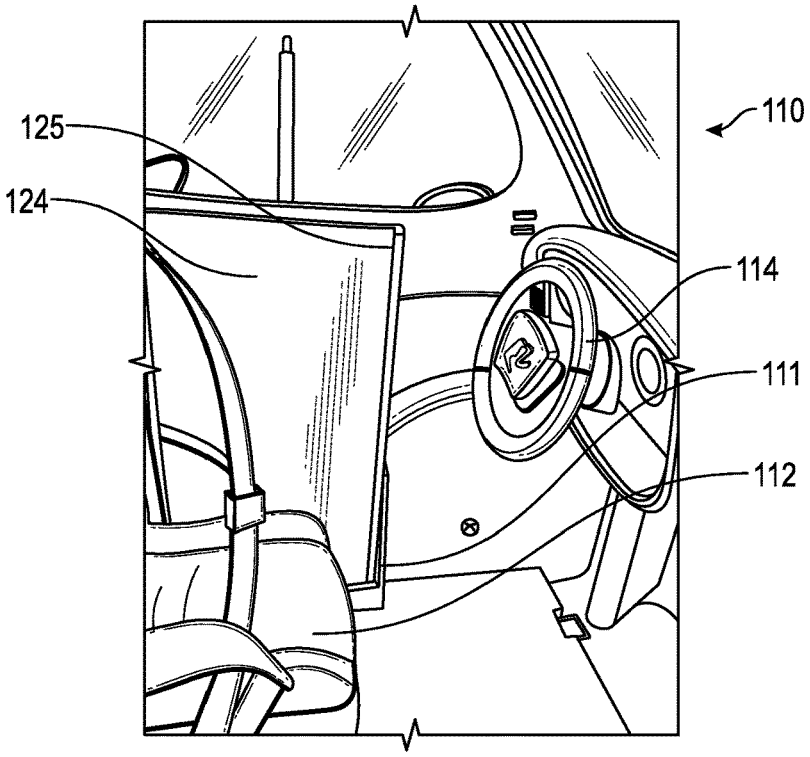
FIGS. 6A and 6B depict internal mechanism by which the expansion of the cab and the vehicle body is effected.
Figure 6B:
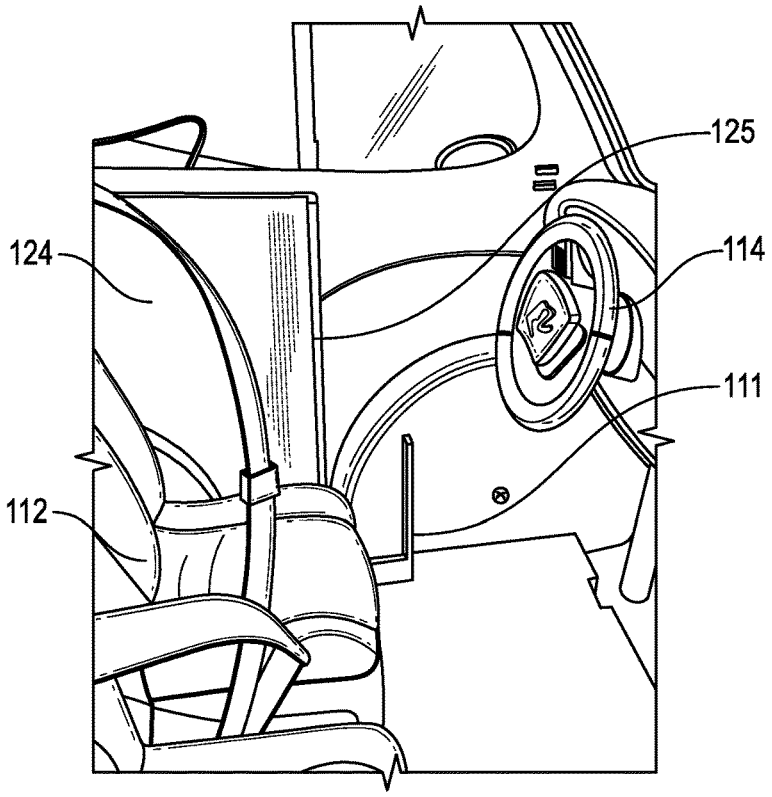
Figure 7A:
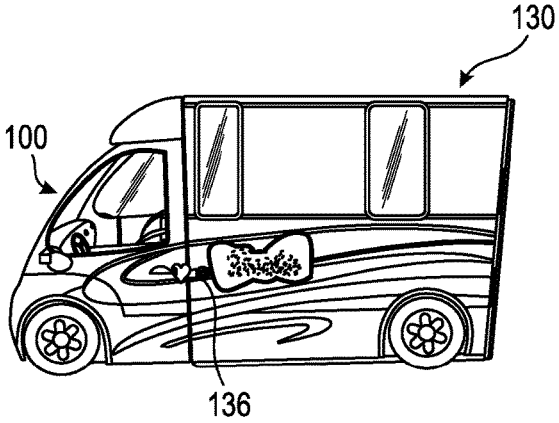
FIGS. 7A-E depict the sequence of detaching the trailer from the cab.
Figure 7B:
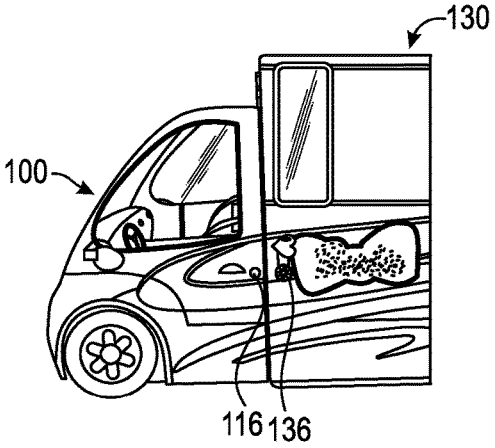
Figure 7C:
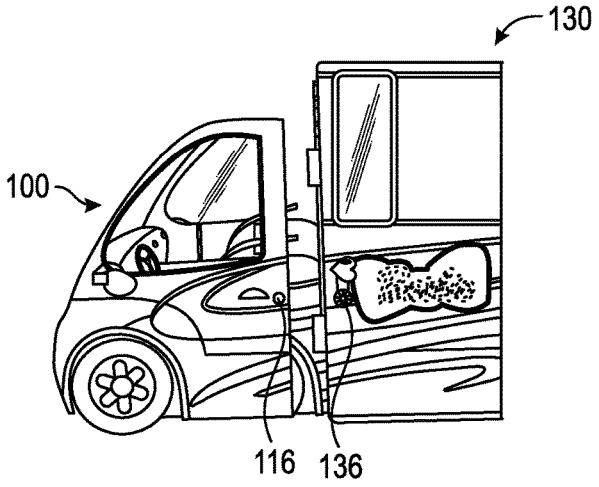
Figure 7D:
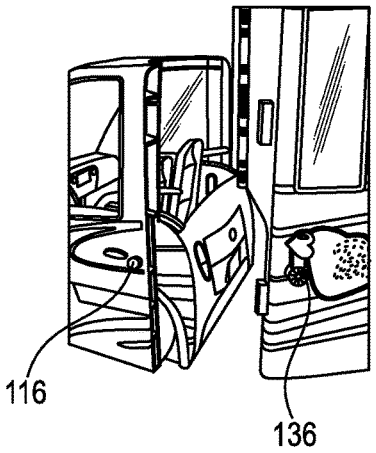
Figure 7E:
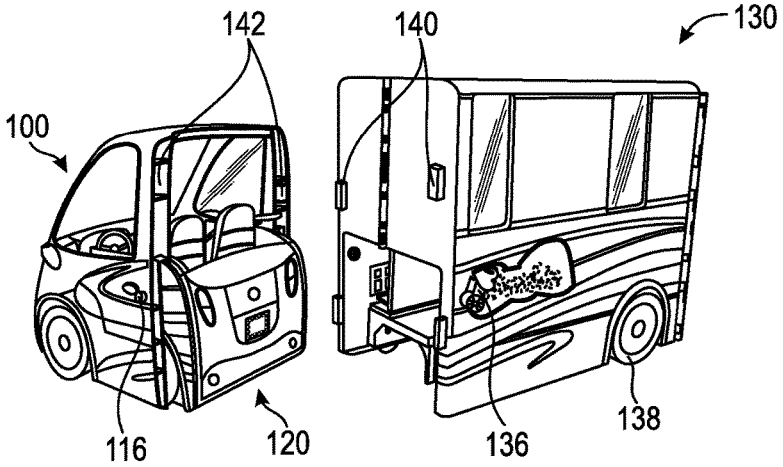

FIGS. 2A and 2B depict the multi-configurable toy vehicle in the expanded configuration. In one embodiment, the toy vehicle may be configured in the expanded configuration by separately grasping the cab 100 and the vehicle body 120 and pulling the cab 100 and vehicle body 120 in opposing directions to slidably move them apart from one another. In the expanded configuration, the toy vehicle may hold up to four figurines, two in the cab 100 and another two in the vehicle body 120. As shown in FIGS. 2A and 2B, the vehicle body 120 is fully exposed and comprises a pair of side walls 124, a rear wall 122 and a pair of rear wheels 128. The rear wall 122 preferably comprises a pair of side walls 126. It is to be understood that the side walls 124 are slidably disposed within the cavity 110 of the cab 100 as shown in FIGS. 6A and 6B. The side walls 124 preferably include stops or protrusions 125 that may be angled relative to the side wall 124. The cab 110 may, in turn, be provided with a corresponding abutment 111 which limits the movement of the side walls 124 and the body in the collapsed state.

Figure 3A:
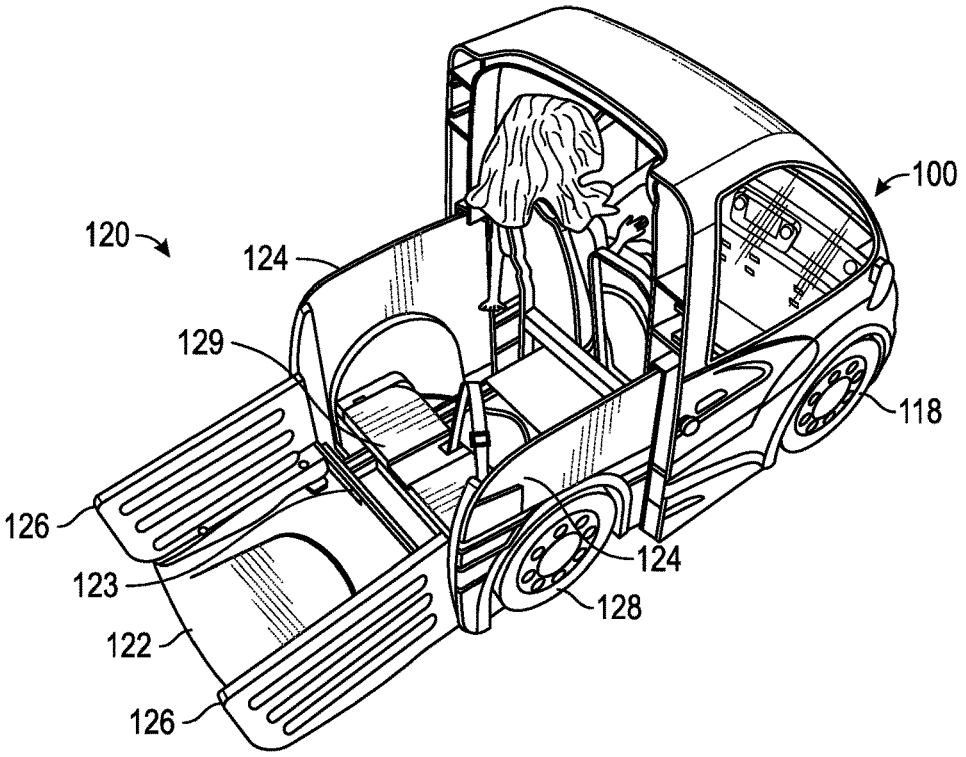
FIGS. 3A and 3B are top perspective views of an embodiment of the multi-configurable toy vehicle in which the platform is pivotally open position.
Figure 3B:
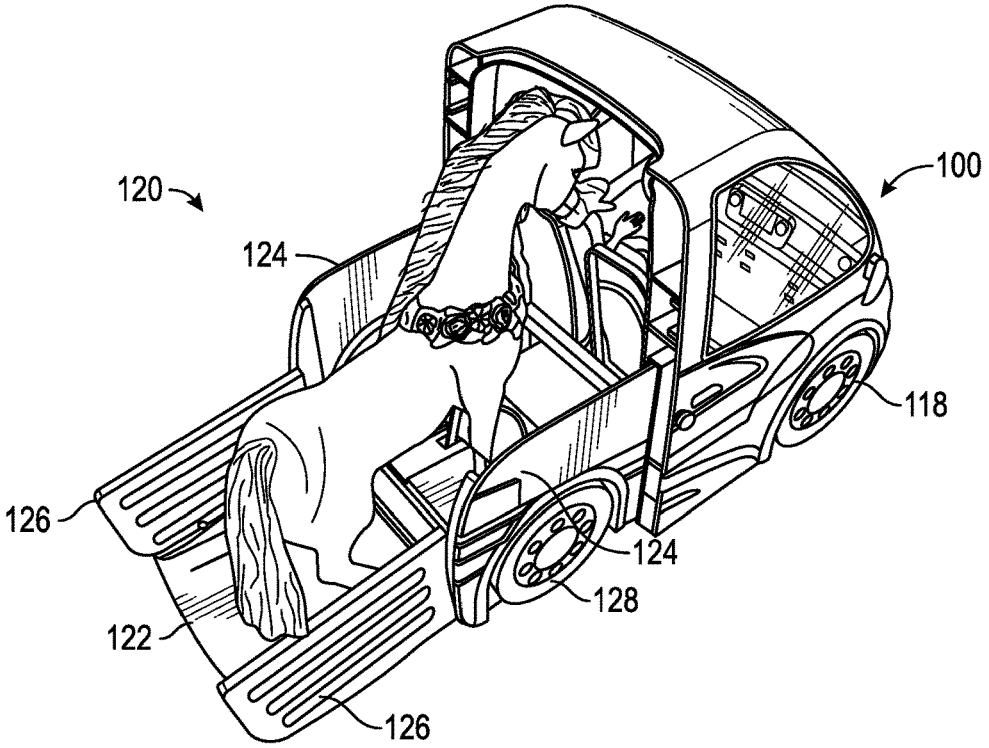

The multi-configurable toy vehicle may be provided in yet a further configuration, as shown in FIGS. 3A and 3B. As previously indicated, the vehicle body 120 comprises a rear wall 122. This rear wall 122 may double as a platform for a truck bed on which a further toy figurine or animal, such as a toy horse, as depicted in FIG. 3B, may be provided. The platform may also support additional accessories, such as toy luggage or toy camping gear. In a preferred embodiment, the rear wall 122 is pivotally coupled to the edge 123 of the vehicle body 120 and may be actuated in an upright or closed position, as shown in FIGS. 2A and 2B, or in an open position, as shown in FIGS. 3A and 3B. In a preferred embodiment, the rear wall 122 further comprises a pair of side walls 126 which, in the upright position, is fully contained within thevehicle body 120. In some embodiments, the seats 129 provided in the vehicle body 120 may be removed to permit use of the toy vehicle as a truck to transport large accessory toys.

Figure 8A:
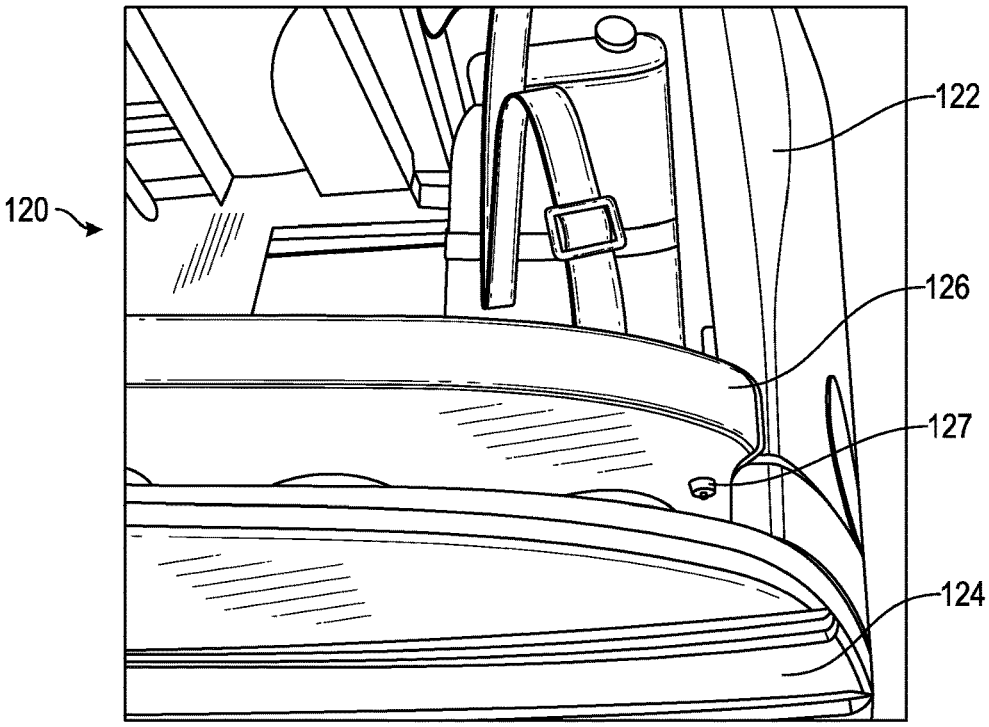
FIGS. 8A, 8B and 8C depict the sequence of pivotally opening the platform.
Figure 8B:
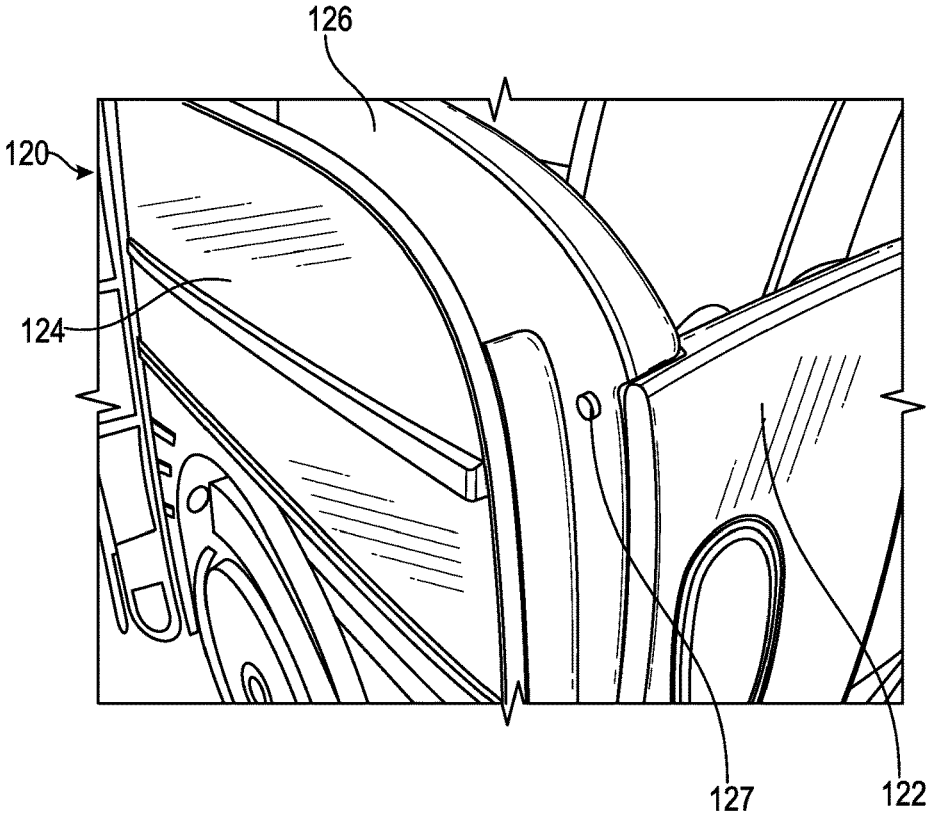
Figure 8C:
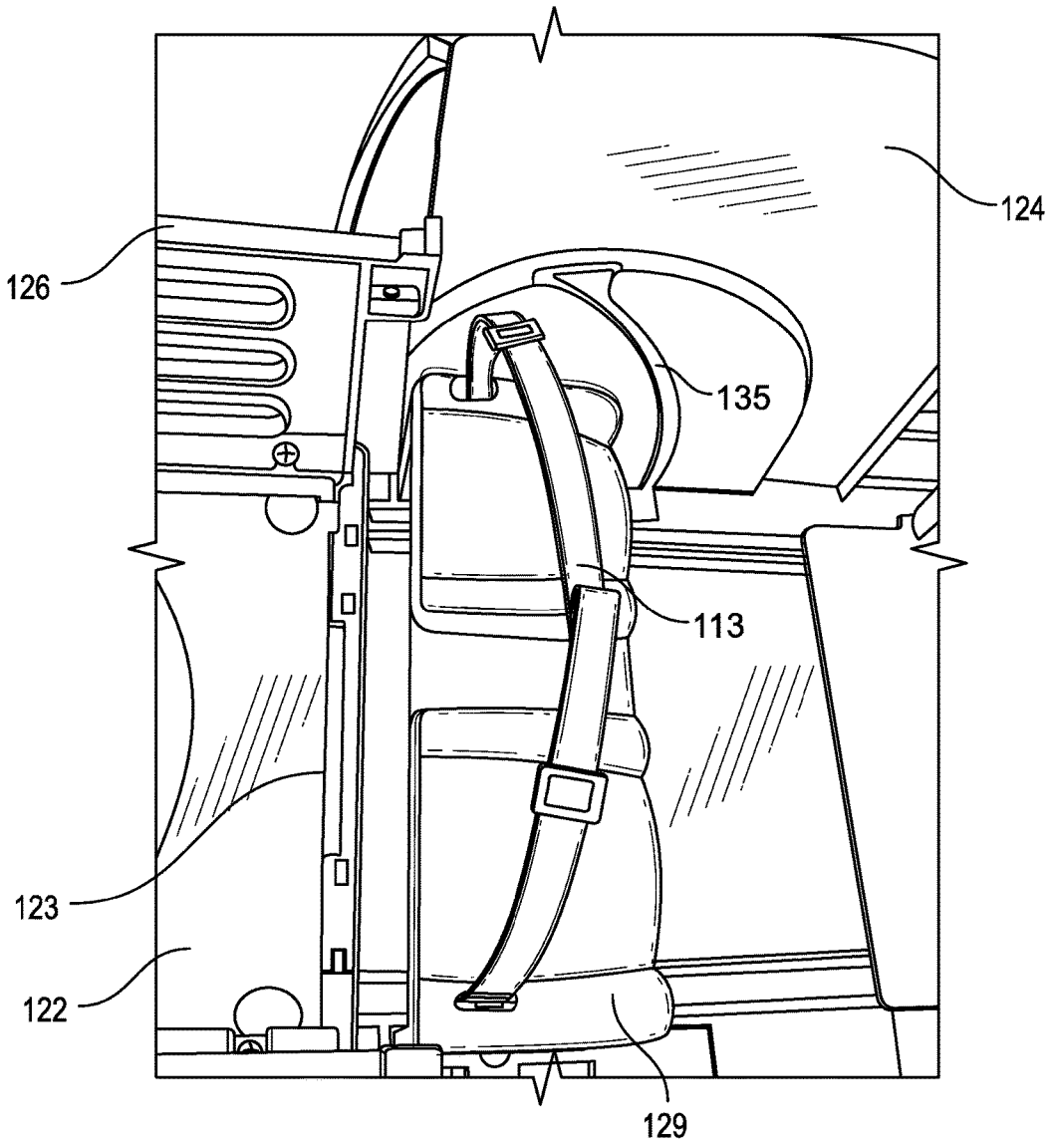

FIGS. 8A and 8B depict one embodiment in which the rear wall or platform 122 is actuated from an upright position (FIG. 8A), towards an open position (FIG. 8B) and finally in the open position (FIG. 8C). Here, the platform 122 is depicted as comprising two side walls 126 rigidly attached to the platform 122 being fully contained within the vehicle body 120 in the upright position. One or both of the side walls may further comprise a protrusion 127 that is configured to maintain the platform 122 in the upright position. A rounded track 135 may further be provided on the interior walls 124 of the vehicle body 120 to assist in guiding the movement of the platform 122 between the upright and the open positions.

Figure 9A:
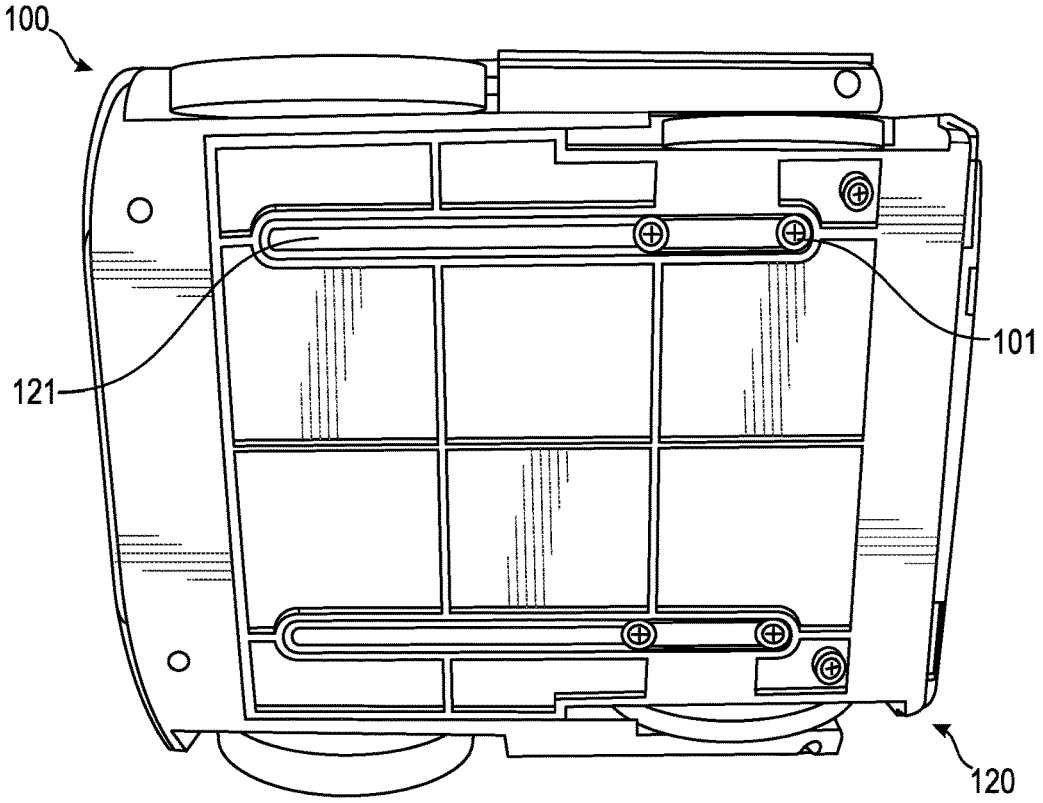
FIGS. 9A, 9B and 9C depict the underside of the multi-configurable vehicle in collapsed, expanded and open platform configurations, respectively.
Figure 9B:
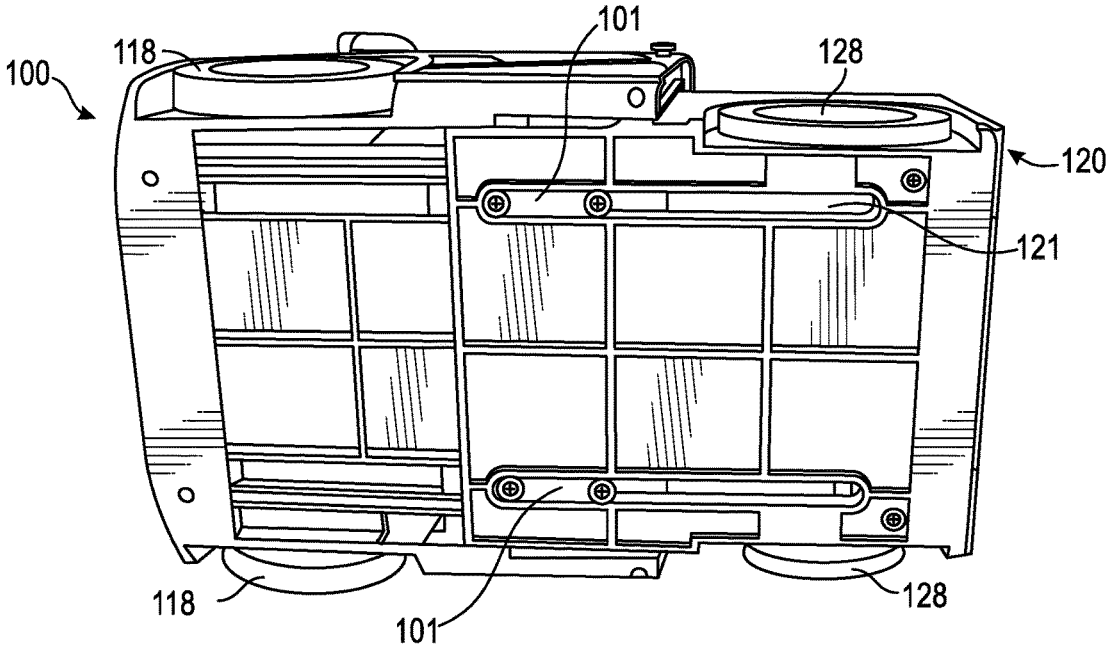
Figure 9C:
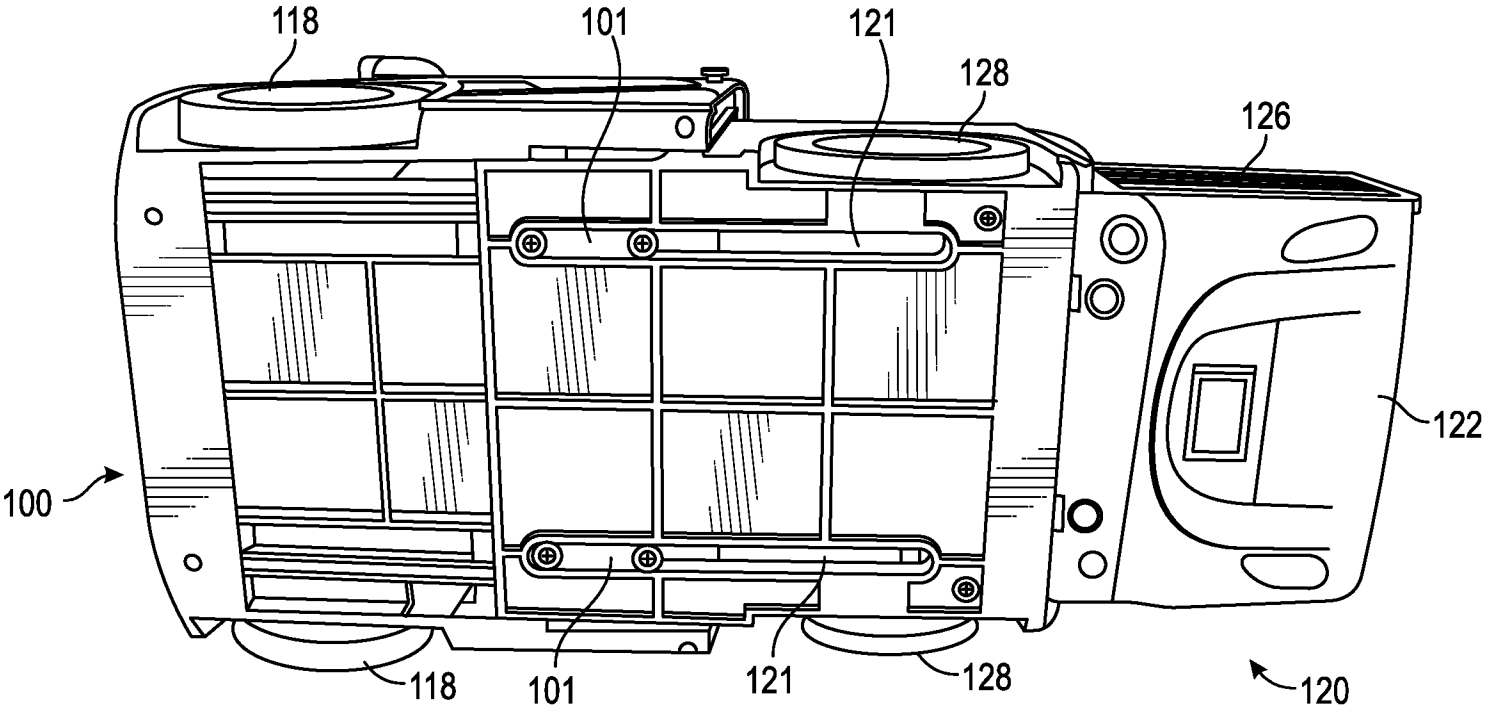

FIGS. 9A, 9B and 9C depict the underside of the toy vehicle in the collapsed, expanded, and open configurations, respectively. The actuation of the toy vehicle between the collapsed and expanded configurations may be accomplished by a projection 101 disposed on the cab 100 and a longitudinal slot 121 disposed on the vehicle body 120 to facilitate the sliding movement between the cab 100 and the vehicle body 120. The interaction of the projection 101 with the longitudinal slot 121 not only connects the cab 100 with the vehicle body 120, but the longitudinal slot 121 helps to define the extent to which the cab 100 and the vehicle body 120 may slide relative to each other. FIG. 9C shows the final configuration of the toy vehicle as the cab 100 and the vehicle body 120 is expanded and the platform 122 is in the open position.

Figure 4A:
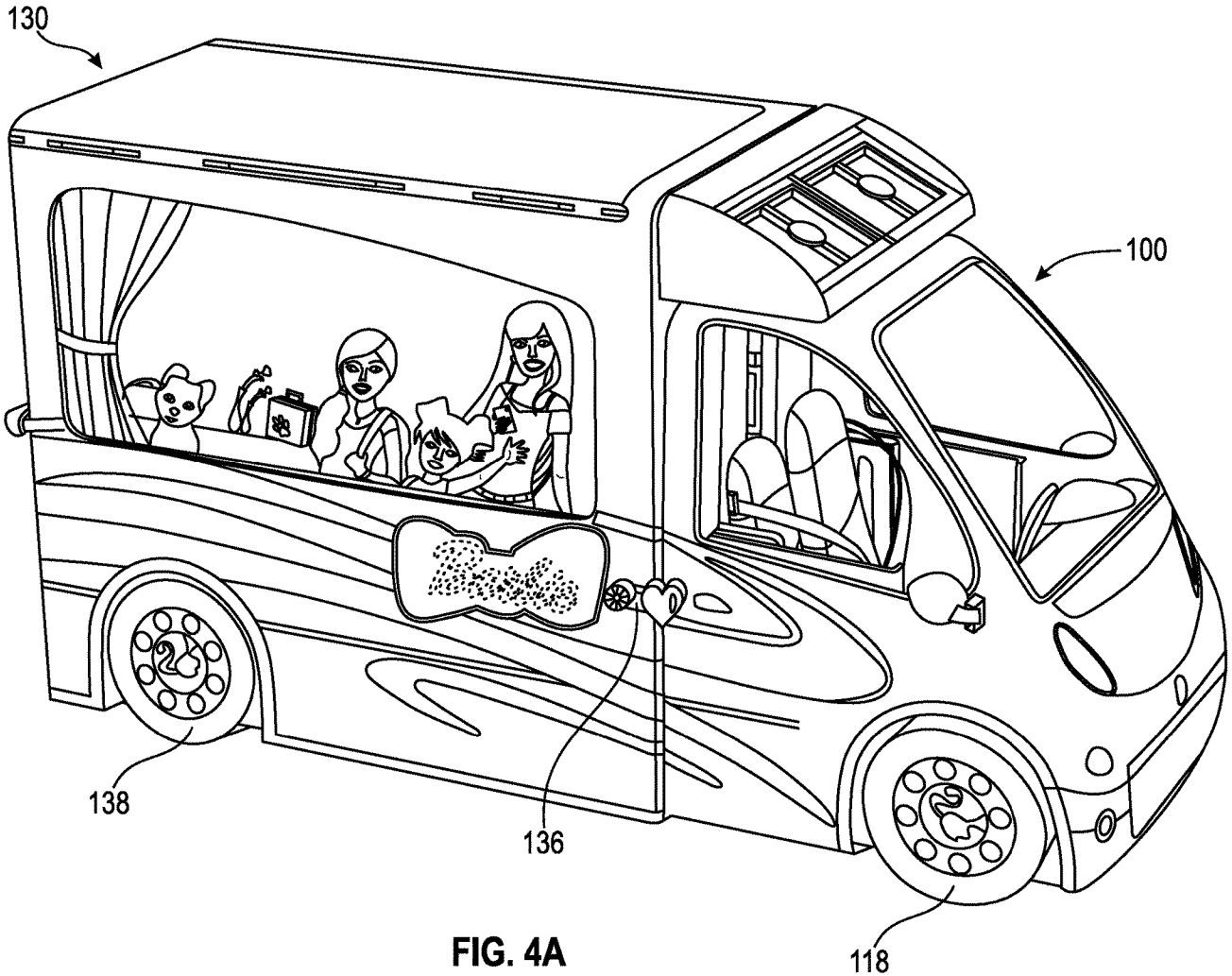
FIGS. 4A, 4B and 4C are perspective and side views of an embodiment of the multi-configurable toy vehicle in which a trailer is attached to the cab.
Figure 4B:
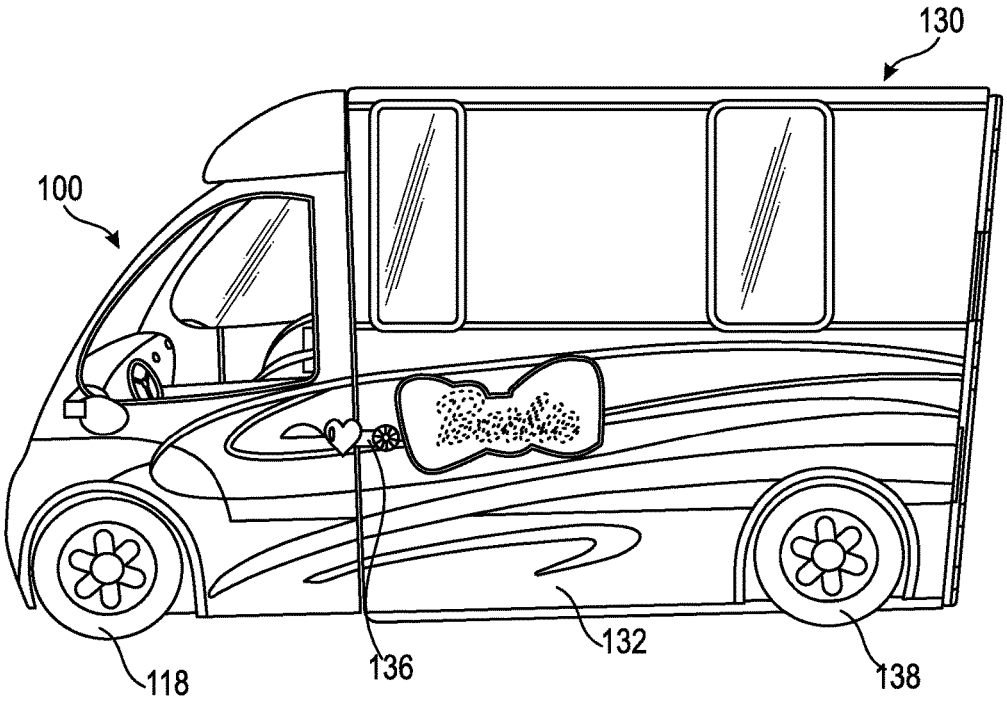
Figure 4C:
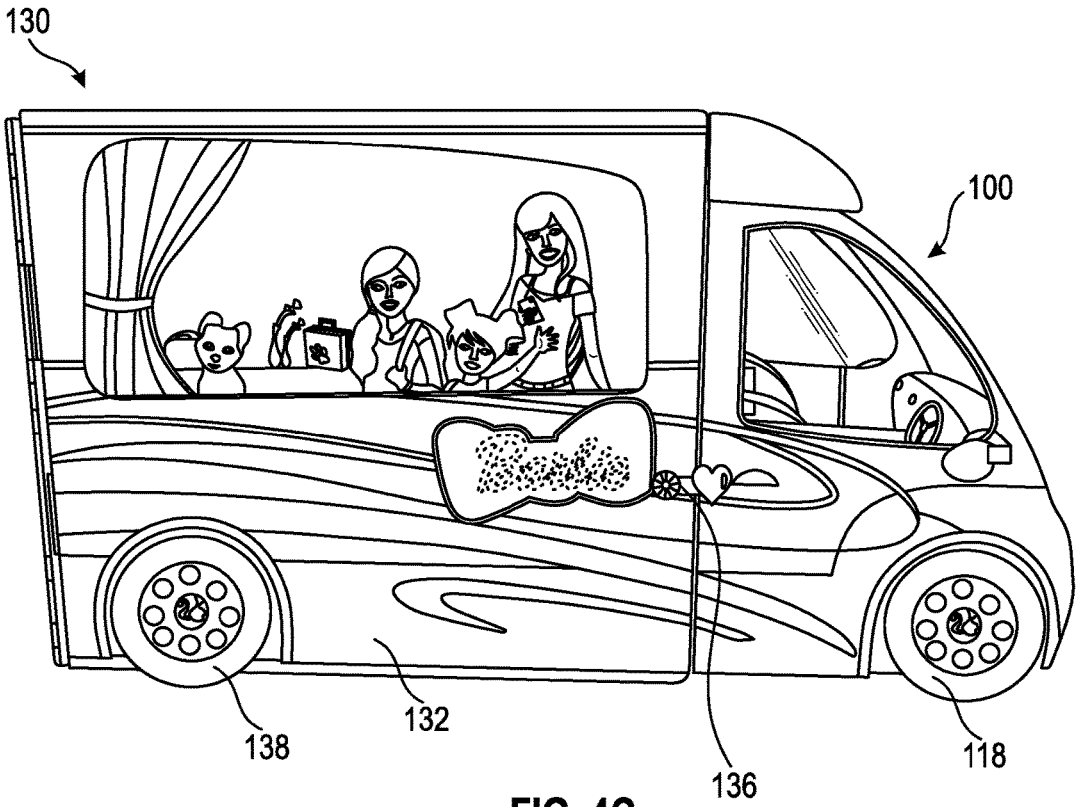

In yet a further configuration, the multi-configurable toy vehicle may be provided with a detachable trailer 130, as shown in FIGS. 4A-C and 7A-E. The trailer 130 may be attached to the cab 100 when it is in the collapsed configuration (See FIG. 7E) by way of a system of tabs and slots, as well as a pivoting latch 136 disposed on the trailer 130. In the illustrated embodiment, tabs 140 on the trailer 130 frictionally fit with corresponding slots 142 on the cab 100. The tabs and/or slots may be offset symmetrically to aid in proper alignment of the trailer 130 with the cab 100. The pivoting latch 136 may couple with the protrusion 116, which serves as the attachment point for the pivoting latch 136. The trailer 130 comprises two side portions 132 hingedly attached to one another and a pair of wheels 138 (as shown in FIGS. 4B and 4C). The sequencing of detaching the trailer 130 from the cab 100 is depicted in FIGS. 7A-E.

Figure 5:
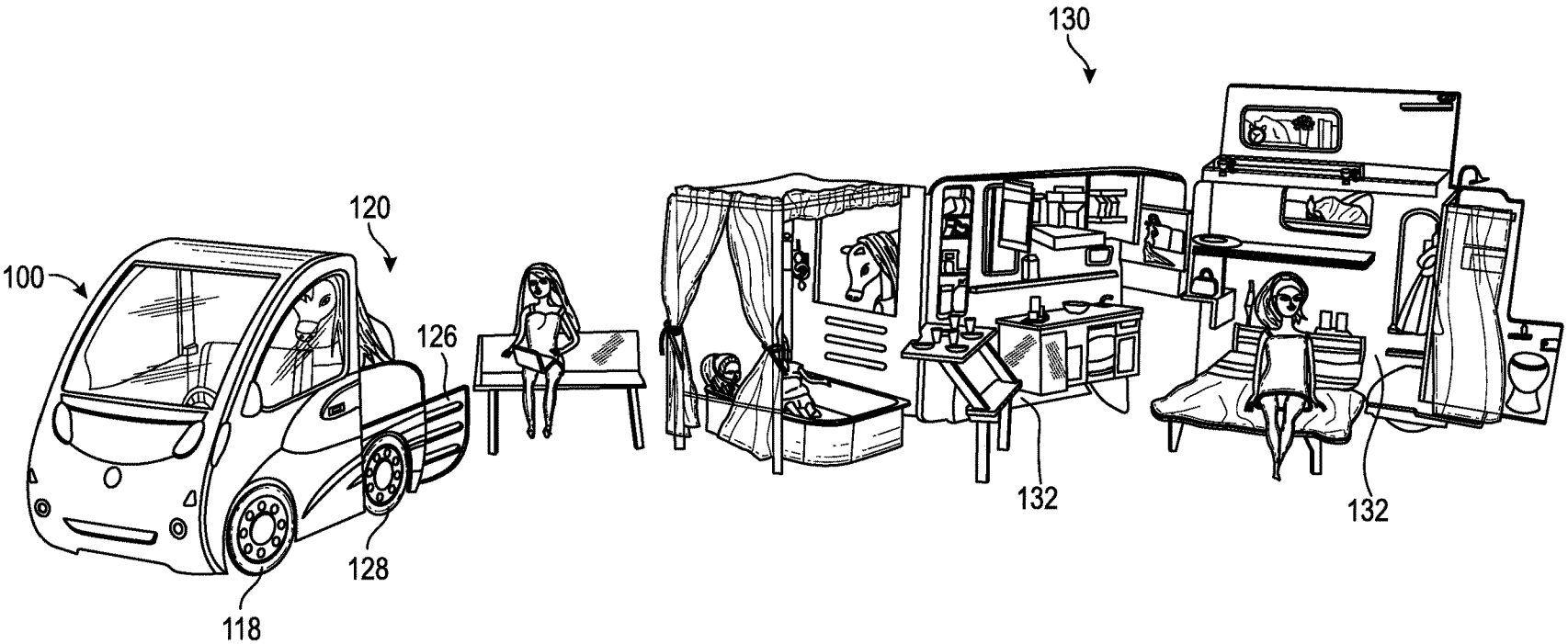
FIG. 5 is a perspective view of the multi-configurable vehicle and trailer, in which the trailer is opened along a hinge to define a play area.

In a preferred embodiment, the trailer 130 defines a further play area, as depicted in FIG. 5. Here, the vehicle is shown with the cab 100 and the vehicle body 120 in an expanded configuration and the platform 122 in an open position. The trailer 130 is detached from the cab 100, and the two side portions 132 are opened along the hinge to reveal a living quarters for the doll.

Some of the basic features of the multi-configurable toy vehicle are described as follows. It is understood that this listing is not a comprehensive listing of the features, but merely illustrates one exemplary embodiment of the toy vehicle.

What is claimed is:

1. A multi-configurable toy vehicle comprising:

a cab comprising a first set of one or more wheels; and a vehicle body comprising a second set of one or more wheels, the vehicle body being slidably coupled to the cab between a collapsed and an expanded configuration, wherein the vehicle body comprises a floor and a platform pivotally coupled to the floor between an upright position and an open position.

2. The multi-configurable toy vehicle as described in 1, wherein the cab comprises an internal cavity configured to house a figurine.

3. The multi-configurable toy vehicle as described in 1, wherein the vehicle body comprises a first pair of side walls that are substantially disposed within the cab in the collapsed configuration.

4. The multi-configurable toy vehicle as described in 1, wherein the second set of wheels is substantially disposed within the cab in the collapsed configuration.

5. The multi-configurable toy vehicle as described in 1, wherein the vehicle body comprises a first pair of side walls that includes one or more surface features along a distal end proximal to the cab that operate to limit the extent of body travel into the cab in a collapsed configuration.

6. The multi-configurable toy vehicle as described in 1, wherein the vehicle cab comprises one or more projections extending from a bottom surface and that are disposed within respective elongated slots disposed along a bottom of the vehicle body floor to facilitate movement between the collapsed and expanded configurations.

7. The multi-configurable toy vehicle as described in 6, wherein the vehicle cab comprises two projections that are each disposed in respective elongated slots.

8. The multi-configurable toy vehicle as described in 1, wherein the platform further comprises a second pair of side walls.

9. The multi-configurable toy vehicle as described in 8, wherein in an upright position, an enclosure is defined by the floor, the second pair of side walls, and the platform.

10. The multi-configurable toy vehicle as described in 9, wherein in the upright position the second pair of side walls is substantially disposed within the first pair of side walls.

11. The multi-configurable toy vehicle as described in 10, comprising a surface feature extending from one or both of the first or second pair of side walls to releasably retain the platform in the upright position.

12. The multi-configurable toy vehicle as described in 1, further comprising a trailer.

13. The multi-configurable toy vehicle as described in 12, wherein the trailer comprises two portions hingedly attached to one another, the two portions being configured to open to define a play area and to close for attachment to the cab.

14. The multi-configurable toy vehicle as described in 12, wherein the trailer is coupled to the cab when the cab and body are in the collapsed state.

15. The multi-configurable toy vehicle as described in 14 wherein the trailer and cab include surface features placed along adjacent surfaces that complement one another to facilitate an aligned fitment of the trailer to a back surface of the cab when coupled thereto.

16. The multi-configurable toy vehicle as described in 15 wherein the cab includes one or more slots disposed along the back surface, and the trailer comprises one or more tabs projecting from a surface of the trailer placed adjacent the cab back surface when coupled thereto, and wherein the slots are sized and positioned to accommodate placement of the tabs therein.

17. The multi-configurable toy vehicle as described in 14 wherein the cab includes a protrusion extending from a side surface, and the trailer includes a latch movably disposed thereon, wherein when the trailer is coupled together the latch is positioned to engage the protrusion.

18. A multi-configurable toy vehicle comprising:

a cab comprising a first pair of wheels and an internal compartment configured to accommodate a toy figurine therein; and a vehicle body slidably coupled to the cab between a collapsed and an expanded configuration, wherein in a collapsed configuration a majority of the body is disposed in the cab, wherein in an expanded configuration a majority of the body extends outwardly from a rear portion the cab, the vehicle body comprises a second pair of wheels, a floor, and a pair of opposed side walls projecting upwardly from the floor, and a rear wall attached to the floor between the side walls and defining an end of the body, wherein the side walls and rear wall together define a storage area within the body for accommodating one or more play elements therein, wherein the rear wall is pivotally coupled to the floor between an upright position and an open position.

19. The multi-configurable toy vehicle as recited in claim 18 further comprising a trailer connected to the cab when the vehicle body is in a collapsed configuration to transform the cab to a combined cab and trailer vehicle, wherein the trailer comprises an enclosed housing having a front wall with attachment elements configured to releasably connect with a rear portion of the cab, the trailer comprising a pair of wheels so that when connected to the cab provides a rolling cab and trailer vehicle.

20. A multi-configurable toy vehicle comprising:

a cab comprising a first pair of wheels and an internal compartment configured to accommodate a toy figurine therein; and a vehicle body slidably coupled to the cab between a collapsed and an expanded configuration, the vehicle body comprising a second pair of wheels and including a floor, opposed side walls projecting upwardly from the floor, and a rear wall movably attached to the floor adjacent an end of the body opposite the cab;

a trailer connected with the cab and comprising a housing having an attachment element for providing a releasable connection with an adjacent rear portion of the cab, the trailer comprising a set of wheels to facilitate rolling movement of the vehicle, the housing comprising one or more movable walls to permit access to an internal space defined within the housing, and wherein the housing is detachable from the cab to provide a play environment for use with a toy figurine.

* * * * *